US010122130B2

(12) United States Patent
Yi et al.

(10) Patent No.: US 10,122,130 B2
(45) Date of Patent: Nov. 6, 2018

(54) CONNECTOR ASSEMBLY WITH AN INSULATOR

(71) Applicant: TYCO ELECTRONICS CORPORATION, Berwyn, PA (US)

(72) Inventors: Chong Hun Yi, Mechanicsburg, PA (US); Dustin Carson Belack, Hummelstown, PA (US); Denver Harley Wilson, Palmyra, PA (US)

(73) Assignee: TE CONNECTIVITY CORPORATION, Berwyn, PA (US)

( * ) Notice: Subject to any disclaimer, the term of this patent is extended or adjusted under 35 U.S.C. 154(b) by 0 days.

(21) Appl. No.: 15/273,233

(22) Filed: Sep. 22, 2016

(65) Prior Publication Data

US 2018/0083394 A1 Mar. 22, 2018

(51) Int. Cl.

| | |
|---|---|
| ***H01R 9/05*** | (2006.01) |
| ***H01R 24/38*** | (2011.01) |
| ***H01R 43/24*** | (2006.01) |
| *H01R 103/00* | (2006.01) |

(52) U.S. Cl.

CPC ..... *H01R 24/38* (2013.01); *H01R 43/24* (2013.01); *H01R 2103/00* (2013.01)

(58) Field of Classification Search

CPC ..... H01R 24/38; H01R 9/05

USPC ..... 439/578, 638

See application file for complete search history.

(56) References Cited

U.S. PATENT DOCUMENTS

| | | | | | |
|---|---|---|---|---|---|
| 4,408,822 | A * | 10/1983 | Nikitas | H01R 9/0521 | 439/394 |
| 5,563,562 | A * | 10/1996 | Szwec | H01R 24/44 | 174/152 GM |
| 6,462,637 | B1 * | 10/2002 | Laverick | H01R 4/2433 | 336/107 |
| 6,875,024 | B2 * | 4/2005 | Nagano | H01R 13/41 | 439/578 |
| 6,899,545 | B2 * | 5/2005 | Pollock | H01R 24/52 | 361/302 |
| 7,011,529 | B2 * | 3/2006 | Oldfield | H01R 24/44 | 333/33 |
| 7,144,274 | B2 * | 12/2006 | Taylor | H01B 17/305 | 439/586 |
| 7,217,154 | B2 * | 5/2007 | Harwath | H01R 9/0518 | 439/578 |
| 7,566,243 | B1 * | 7/2009 | Hung | H01R 9/0521 | 439/578 |

(Continued)

*Primary Examiner* — Abdullah Riyami
*Assistant Examiner* — Thang Nguyen

(57) ABSTRACT

A connector assembly is provided comprising, a conductive shell extending between a mating end and a back end opposite the mating end. The shell being generally cylindrical and extending along a longitudinal axis. The shell having a chamber forward of a base and being open at the mating end for receiving the mating connector. The base having an insulator pocket aligned with the longitudinal axis and extending between the chamber and the back end. And a center pin received in the pocket and extending through the base along the longitudinal axis into the chamber for mating with the mating connector. The center pin having a terminating end extending from the back end. And an insulator formed in place in the pocket around the center pin to electrically isolate the center pin from the shell. The insulator maintaining a position of the center pin along the longitudinal axis.

20 Claims, 3 Drawing Sheets

(56) References Cited

U.S. PATENT DOCUMENTS

| | | | | |
|---|---|---|---|---|
| 8,100,715 | B2 * | 1/2012 | Whitlock | H01R 24/38 439/580 |
| 8,475,204 | B2 * | 7/2013 | Blasick | H01R 24/44 439/578 |
| 2005/0233603 | A1 * | 10/2005 | Chen | H01R 13/648 439/63 |
| 2012/0088407 | A1 * | 4/2012 | Natoli | H01R 24/564 439/585 |
| 2013/0137300 | A1 * | 5/2013 | Eriksen | H01R 9/0524 439/583 |
| 2013/0252462 | A1 * | 9/2013 | Tang | H01R 9/0524 439/578 |

* cited by examiner

CONNECTOR ASSEMBLY WITH AN INSULATOR

BACKGROUND OF THE INVENTION

The subject matter herein relates generally to a connector assembly.

Connector assemblies are commonly used to interconnect electrical components together. For example, connectors are sometimes used to communicatively couple a mating connector, such as a cable, and a printed circuit board together. To interconnect the mating connector with a printed circuit board, the mating connector and the printed circuit board are mated with a connector assembly. Other systems use a connector assembly to connect two printed circuit boards. As the electrical components are mated together with the connector assembly, the electrical components communicate with each other. Connector assemblies may communicate with each other by mechanical connection through electrical contacts, mechanical connection, and the like.

Connector assemblies, such as radio frequency (RF) connectors, typically include a center pin contact, an outer body and a retaining ring made of standard copper alloy materials. An insulator is positioned between the pin contact and the outer body. However, known connectors are not without problems. For instance, connector assemblies require complex manufacturing methods to position the pin contact in the insulator or position the insulator in the outer body. Some known connector assemblies include hermetic glass to metal seals between the center pin and the insulator, in order to function properly. Developing a proper glass to metal hermetic seal can be both time consuming and expensive. For example, proper materials must be selected in order to avoid residual thermal stresses between the various components. Furthermore, the connector assembly may require an additional component in order to join the hermetically sealed center pin and insulator to the body. For example, the retaining ring may be required in order to join the center pin and insulator to the body.

Accordingly, a need remains for a connector assembly that may be manufactured in a cost effective and reliable manner.

BRIEF DESCRIPTION OF THE INVENTION

In one embodiment, a connector assembly is provided including, a conductive shell extending between a mating end configured for mating with a mating connector and a back end opposite the mating end. The shell being generally cylindrical and extending along a longitudinal axis. The shell having a base at the back end. The shell having a chamber forward of the base and being open at the mating end for receiving the mating connector. The base having an insulator pocket aligned with the longitudinal axis and extending between the chamber and the back end of the shell. And a center pin received in the insulator pocket and extending through the base along the longitudinal axis into the chamber for mating with the mating connector. The center pin having a terminating end extending from the back end for termination to an electrical component. And an insulator formed in place in the insulator pocket around the center pin to electrically isolate the center pin from the conductive shell. The insulator maintaining a position of the center pin along the longitudinal axis.

In a further embodiment, a method of assembling a connector assembly is provided including providing a generally cylindrical, conductive shell with a pocket formed through a base of the shell between a back end of the shell and a chamber at a mating end of the shell. Positioning a center pin along a longitudinal axis of the shell such that the center pin extends from the pocket rearward of the back end of the shell and such that the center pin extends forward of the pocket into the chamber for mating with a mating connector. And injection molding an insulator in the pocket around the center pin. The insulator being locking into the base to maintain a position of the center pin relative to the shell along the longitudinal axis.

In a further embodiment, a connector assembly is provided including a conductive shell extending between a mating end configured for mating with a mating connector and a back end opposite the mating end. The shell having a base at the back end. The base having an insulator pocket. And a center pin received in the insulator pocket and extending through the base for mating with the mating connector. The center pin having a terminating end extending from the back end for terminating to an electrical component. And an insulator formed into the insulator pocket around the center pin to electrically isolate the center pin from the conductive shell. Wherein the insulator is injection molded into the insulator pocket. The insulator maintaining a position of the center pin relative to the base along a longitudinal axis.

DETAILED DESCRIPTION OF THE INVENTION

Figure 1:
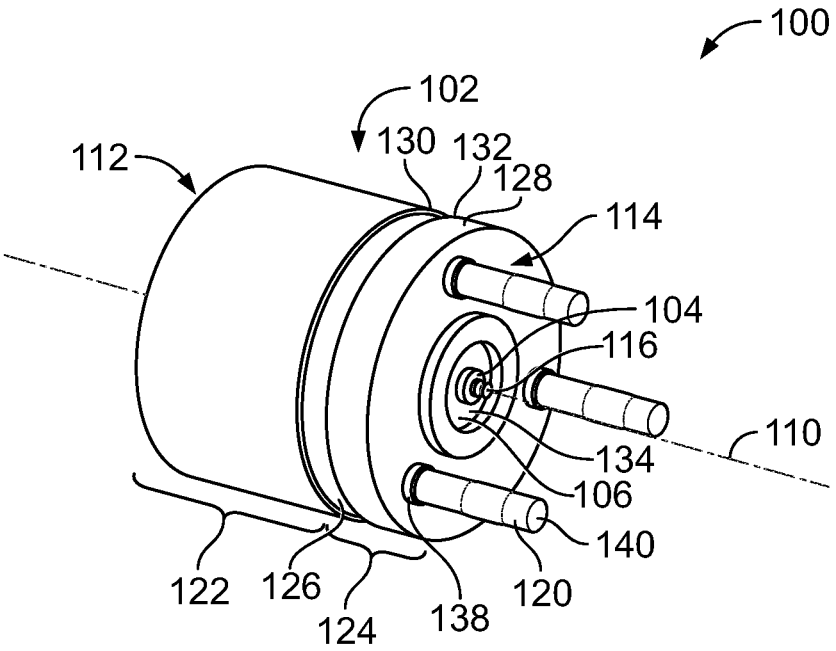
FIG. 1 is a perspective view of a connector assembly in accordance with an embodiment of the present invention.

FIG. 1 is a perspective view of a connector assembly 100 formed in accordance with an exemplary embodiment. The connector assembly 100 includes a conductive shell 102, a center pin 104 and an insulator 106 electrically isolating the center pin 104 from the conductive shell 102. The insulator 106 holds the center pin 104 in the conductive shell 102. In an exemplary embodiment, the insulator 106 is formed inside between the center pin 104 and the conductive shell 102. For example, the insulator 106 may be molded in place in the conductive shell 102 around the center pin 104. In an exemplary embodiment, the connector assembly 100 is a radio frequency (RF) connector assembly. In an alternative exemplary embodiment, the center pin 104, the insulator 106, and the conductive shell 102 combine to create a coaxial structure for transverse electromagnetic mode (TEM) propagation of a high frequency signal. The conductive shell 102 provides electrical shielding for the center pin 104.

The conductive shell 102 is made of a conductive material (for example, copper, bronze, and the like). The conductive shell 102 is a unitary body formed in a generally cylindrical shape and extends along a longitudinal axis 110 between a mating end 112 and a back end 114. Optionally, the conductive shell 102 may be any alternative shape and/or be formed by multiple components. For example, the conductive shell 102 may be formed of two or more components. The conductive shell 102 may have an oval cross-section, rectangular cross-section, or any other appropriate shape. The mating end 112 is configured to be operably joined to a mating connector (not shown). For example, the mating connector may be a cable connector terminated to an end of a cable that may transmit power, high speed data signals, low speed data signals, and the like. Alternatively, the mating connector may be an alternative electrical connector. The back end 114 of the connector assembly 100 is configured to be operably joined to an electrical component (not shown). For example, the electrical component may be a printed circuit board. The connector assembly 100 electrically interconnects the mating connector with the electrical component. For example, the connector assembly 100 electrically joins the mating connector with the electrical component by physical engagement with the mating connector and physical engagement with the electrical component.

The conductive shell 102 includes a base 124 and a mating portion 122. The base 124 has a generally circular cross-section about the longitudinal axis 110. The base 124 includes a shell groove 126 and a base flange 128. The shell groove 126 and the base flange 128 are generally concentric about the longitudinal axis 110. The shell groove 126 extends along the longitudinal axis 110 between a front groove lip 130 and a rear groove lip 132. The base flange 128 extends along the longitudinal axis 110 between the rear groove lip 132 and the back end 114. The base flange 128 has a circular cross-section with a diameter that is larger relative to a diameter of the shell groove 126. For example, the diameter of the shell groove 126 is smaller than the diameter of the base flange 128. Optionally, the shell groove 126 and base flange 128 may have a uniform cross-section about the longitudinal axis 110.

The mating portion 122 has a circular cross-section and is elongated along the longitudinal axis 110 between the front groove lip 130 of the shell groove 126 and the mating end 112. Alternatively, the mating portion 122 may have an alternative cross-sectional shape. The mating portion 122 has a diameter that is generally uniform with the diameter of the base flange 128. Optionally, the mating portion 122 may have a diameter that is unique to the diameter of one or more of the shell groove 126 or the base flange 128. Optionally, the mating portion 122 may have a cross-sectional shape that is unique to the cross-sectional shape of one or more of the shell groove 126 or the base flange 128. For example, the mating portion 122 may be circular while the base 124 may be rectangular.

The insulator 106 is joined to the base 124 of the conductive shell 102. This insulator 106 is made of an insulating material (for example, a liquid crystal polymer, non-conductive elastomer, and the like). The insulator 106 includes a rear end 134 that is observed at the back end 114 of the conductive shell 102. The rear end 134 and the back end 114 may be generally coplanar. Optionally, the rear end 134 and the back end 114 may not be coplanar. The insulator 106 receives the center pin 104 within a central bore of the insulator 106, described in more detail below.

The center pin 104 is made of a conductive material (for example, copper, bronze, and the like). The center pin 104 and the conductive shell 102 may be made of the same conductive material, or the center pin 104 may be made of a unique conductive material. A terminating end 116 of the center pin 104 extends from the rear end 134 of the insulator 106 along the longitudinal axis 110 in a direction generally away from the insulator 106.

The connector assembly 100 has one or more connector pins 120 that are configured to be joined to the back end 114 of the conductive shell 102 and extend in a direction generally away from the connector assembly 100 along the longitudinal axis 110. The connector pins 120 have a proximal end 138 and a distal end 140. The proximal end 138 is positioned near and operably joined to the conductive shell 102 at the back end 114. The distal end 140 is positioned remote of the back end 114. Optionally, the connector pins 120 may be integral with the conductive shell 102. In the illustrated embodiment, the connector assembly 100 has three connector pins 120 joined to the conductive shell 102. However, any number of connector pins 120 may be provided in alternative embodiments. The connector pins 120 are used to mechanically secure the connector assembly 100 to the circuit board or other electrical components. The connector pins 120 may be electrically commoned or grounded to the circuit board.

Figure 2:
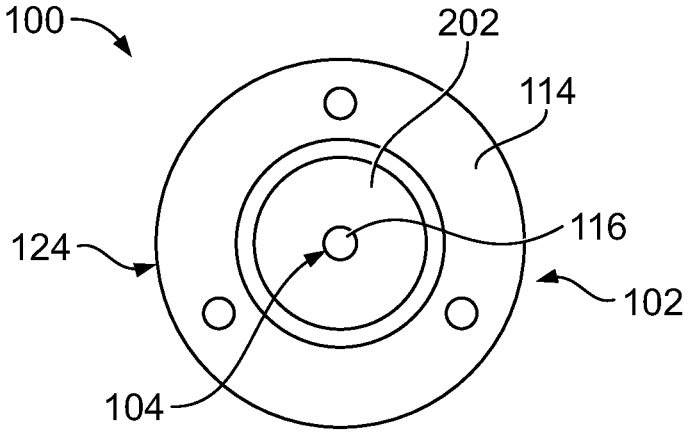
FIG. 2 is a front perspective view of a connector assembly in accordance with an embodiment of the present invention.

FIG. 2 is a front perspective view of the connector assembly 100 in accordance with an exemplary embodiment. The back end 114 of the conductive shell 102 and the terminating end 116 of the center pin 104 are illustrated. The center pin 104 is positioned within a concentric space 202 defined in the conductive shell 102. The concentric space 202 is defined as the area around the center pin 104 between the center pin 104 and the base 124 of the conductive shell 102. The insulator 106 is configured to be formed in the concentric space 202 around the center pin 104. For example, the insulator 106, the conductive shell 102 and the center pin 104 are concentric about the longitudinal axis 110.

Figure 3:
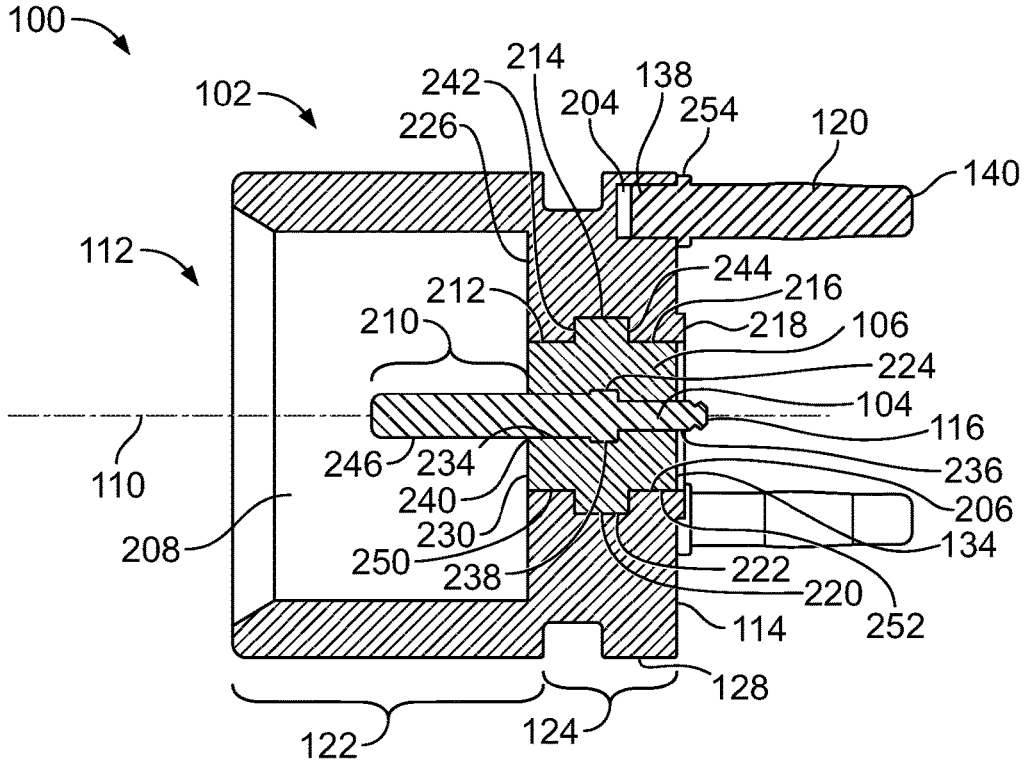
FIG. 3 is a cross-section view of a connector assembly in accordance with an embodiment of the present invention.
Figure 4:
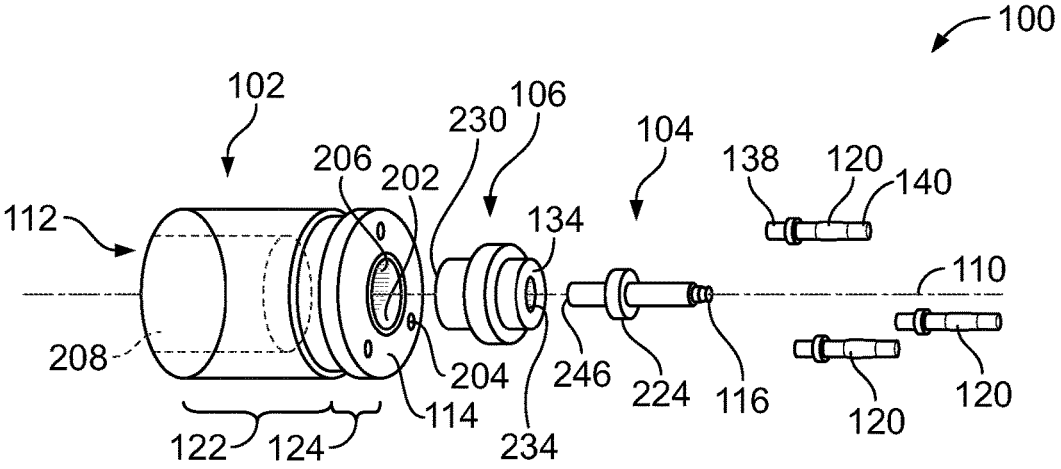
FIG. 4 is an exploded view of a connector assembly in accordance with an embodiment of the present invention.

FIG. 3 is a cross-sectional view of the connector assembly 100 in accordance with an exemplary embodiment. FIG. 4 is an exploded view of the connector assembly 100 in accordance with an exemplary embodiment. The conductive shell 102 has a chamber 208 that extends forward of the base 124 to the mating end 112. The chamber 208 extends within the mating portion 122 of the connector assembly 100. The chamber 208 is open at the mating end 112 to receive a mating connector (not shown).

The base 124 has an insulator pocket 206 in the concentric space 202 (of FIG. 2) that extends between a front end 226 of the base 124 and the back end 114. The insulator pocket 206 is open at the front end 226 and back end 114, and is hollow between the front and back ends 226, 114. The insulator pocket 206 of the base 124 is axially aligned with the longitudinal axis 110. The insulator pocket 206 is open to the chamber 208 at the front end 226 of the base 124. For example, the chamber 208 and the insulator pocket 206 provide an open passage between the mating end 112 and the back end 114 of the conductive shell 102.

The insulator pocket 206 has a locking groove 220. The locking groove 220 extends entirely circumferentially around the insulator pocket 206 about the longitudinal axis 110. The locking groove 220 is positioned between a pocket front rim 212 and a pocket rear rim 216. For example, the pocket front rim 212 is positioned between the chamber 208 and the locking groove 220, and the pocket rear rim 216 is positioned between the locking groove 220 and the back end 114. The locking groove 220 has a first diameter larger than second and third diameters of the front and rear rims 212, 216, respectively. The front rim 212 is positioned near the front end 226 of the base 124. For example, the front rim 212 is positioned proximate the chamber 208. The rear rim 216 is positioned near the back end 114. For example, the rear rim 216 is positioned remote from the chamber 208. The front and rear rims 212, 216 and locking groove 220 are generally concentric about the longitudinal axis 110.

The center pin 104 is received generally within a center of the insulator pocket 206 along the longitudinal axis 110. For example, the center pin 104 is positioned within the concentric space 202 (of FIG. 2). The center pin 104 has the terminating end 116 and a mating end 246. The terminating end 116 extends from the back end 114 in a direction generally away from the conductive shell 102 along the longitudinal axis 110. For example, the terminating end 116 protrudes rearward beyond a plane of the back end 114 of the conductive shell 102. The terminating end 116 terminates with an electrical component (not shown) when the electrical component is joined to the connector assembly 100. The terminating end 116 electrically joins the connector assembly 100 to the electrical component by physical engagement with the electrical component. The pin mating end 246 extends a distance 210 away from the front end 226 of the base 124 into the chamber 208 along the longitudinal axis 110. For example, the pin mating end 246 extends into the mating portion 122 of the conductive shell 102. The pin mating end 246 mates with a mating connector (not shown) when the mating connector is joined to the connector assembly 100 within the chamber 208. The pin mating end 246 electrically joins the connector assembly 100 to the mating connector by physical engagement with the mating connector.

In an exemplary embodiment, the insulator 106 is a molded body that is formed in place in the insulator pocket 206 of the conductive shell 102 entirely circumferentially around the center pin 104. The insulator 106 is embedded into the conductive shell 102 and is formed in the concentric space 202 (of FIG. 2). For example, the insulator 106 may be injection molded in situ into the insulator pocket 206 around the center pin 104. The insulator 106 electrically isolates the center pin 104 from the conductive shell 102. The insulator 106 is formed with a locking rib 222 defined by a flange 214. The locking rib 222 is positioned between an insulator front segment 250 and an insulator rear segment 252. The flange 214 of the locking rib 222 has a diameter larger relative to the diameters of the front and rear segments 250, 252, respectively. The locking rib 222 has a front shoulder 242 and a rear shoulder 244. The front and rear shoulders 242, 244 may be are perpendicular to the longitudinal axis 110. The locking rib 222 is formed into the locking groove 220 of the base 124 such that the front and rear shoulders 242, 244 engage the locking groove 220 within the insulator pocket 206. The locking rib 222 adopts the shape of the locking groove 220 when molded in place in the base 124. For example, the insulator 106 may be injection molded into the insulator pocket 206 such that the insulator 106 fills the space of the locking groove 220. The locking rib 222 holds an axial position of the insulator 106 within the base 124 along the longitudinal axis 110. For example, the flange 214 of the locking rib 222 extends into the locking groove 220 to maintain a linear position of the insulator 106 relative to the base 124 of the conductive shell 102.

The insulator 106 has a central bore 234. The central bore 234 extends between a front end 230 and the rear end 134 of the insulator 106. The central bore 234 is a hollow passage between the front and rear ends 230, 134 of the insulator 106. The central bore 234 has a front bore segment 240 at the front end 230 and a rear bore segment 236 at the rear end 134. In the illustrated embodiment, the diameter of the front bore segment 240 is larger relative to the diameter of the rear bore segment 236. Optionally, the diameters of the front and rear bore segments 240, 236 may be uniform.

The center pin 104 has a flange 224 that extends entirely circumferentially around the center pin 104. The flange 224 is received in a pocket or groove 238 in the central bore 234. The flange 224 has a larger diameter relative to the diameter of the front bore segment 240 and the rear bore segment 236. The insulator 106 is formed around the center pin 104 such that the center pin 104 extends through the central bore 234. The insulator 106 maintains a position of the center pin 104 along the longitudinal axis 110. For example, the flange 224 engages the insulator 106 and is locked in the groove 238 to maintain an axial position of the center pin 104 within the central bore 234 of the insulator 106. The center pin flange 224 is located centrally to the locking rib 222 of the conductive shell 102. For example, the flange 224 is located centrally such that the impedance of the coaxial system is maintained and step capacitance discontinuities are optimized by the inductive cross-section before and after the center pin flange 224.

The conductive shell 102 has a standoff 218 at the back end 114. The standoff 218 is a surface generally planar with the back end 114 of the conductive shell 102. The standoff 218 extends from the conductive shell 102 in a direction generally away from the back end 114. The standoff 218 may engage the electrical component (not shown) to position and/or stabilize the conductive shell 102 on the electronic component. Optionally, the conductive shell 102 may be soldered, welded, mechanically joined, or the like, to the electrical component at the standoff 218. Optionally, the conductive shell 102 may be devoid of the standoff 218. For example, the back end 114 may be joined directly to the electrical component.

The connector pins 120 have a proximal end 138 and a distal end 140. The proximal end 138 is positioned near the back end 114 of the conductive shell 102. A pin flange 254 is positioned near the proximal end 138 and extends perpendicularly away from the connector pin 120. For example, the pin flange 254 has a diameter that is larger relative to a diameter of the connector pin 120. The proximal end 138 is received within a pin pocket 204 to physically engage the connector pin 120 with the conductive shell 102. For example, the connector pin 120 may be coupled to the conductive shell by press-fitting into the pin pocket 204, welding to the back end 114, or the like. Additionally, while FIG. 3 illustrates an assumed two pin pockets 204 receiving two connector pins 120, any number of pin pockets 204 and connector pins 120 may be provided depending on the particular application.

The pin pocket 204 extends into the base flange 128 of the base 124 along the longitudinal axis 110 and is open to the back end 114 of the conductive shell 102. The connector pins 120 extend rearward from the back end 114 of the conductive shell 102. The distal end 140 of the connector pin 120 is configured to be physically engaged with an electrical component (not shown) to electrically and mechanically connect the conductive shell 102 to an electrical component.

Figure 5:
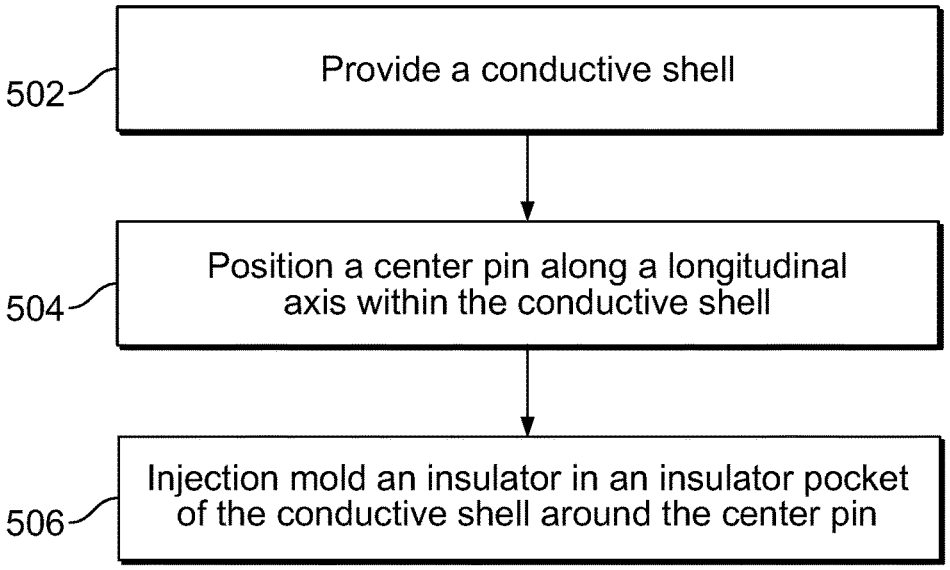
FIG. 5 is a method of assembling a connector assembly in accordance with an embodiment of the present invention.

FIG. 5 is a method of assembling the connector assembly 100 in accordance with an exemplary embodiment. At 502, the conductive shell 102 is provided including the mating end 112 and the back end 114. The chamber 208 extends into the conductive shell 102 at the mating end 112. The conductive shell 102 includes the insulator pocket 206 at the back end 114.

At 504, the center pin 104 is positioned within the conductive shell 102 along the longitudinal axis 110 in the insulator pocket 206. The center pin 104 is positioned within the concentric space 202. The pin mating end 246 extends into the chamber 208. The terminating end 116 of the center pin 104 protrudes from the back end 114 of the conductive shell 102. The center pin 104 may be held in place relative to the conductive shell 102, such as by a fixture or holder.

At 506, the insulator 106 is injection molded in situ into the insulator pocket 206 in the concentric space 202 between the center pin 104 and the conductive shell 102. The insulator 106 may be cured around the center pin 104. The insulator 106 may be cured to the conductive shell 102. For example, the insulator 106 is molded into the insulator pocket 206 around the center pin 104 and embedded into the conductive shell 102. The insulator 106 may be cured such that the insulator locking rib 222 molds into the shape of the locking groove 220 of the conductive shell 102. For example, the insulator 106 front and rear shoulders 242, 244 may take the form of the locking groove 220 as the insulator 106 cures in order to maintain a position of the locking rib 222 within the locking groove 220. The insulator 106 maintains a position of the center pin 104 within the connector assembly 100. For example, the insulator 106 maintains a linear position along the longitudinal axis 110 within the conductive shell 102.

Exemplary embodiments are described and/or illustrated herein in detail. The embodiments are not limited to the specific embodiments described herein, but rather, components and/or steps of each embodiment may be utilized independently and separately from other components and/or steps described herein. Each component, and/or each step of one embodiment, can also be used in combination with other components and/or steps of other embodiments. When introducing elements/components/etc. described and/or illustrated herein, the articles "a", "an", "the", "said", and "at least one" are intended to mean that there are one or more of the element(s)/component(s)/etc. The terms "comprising", "including" and "having" are intended to be inclusive and mean that there may be additional element(s)/component(s)/etc. other than the listed element(s)/component(s)/etc. Moreover, the terms "first," "second," and "third," etc. in the claims are used merely as labels, and are not intended to impose numerical requirements on their objects. Dimensions, types of materials, orientations of the various components, and the number and positions of the various components described and/or illustrated herein are intended to define parameters of certain embodiments, and are by no means limiting and are merely exemplary embodiments. Many other embodiments and modifications within the spirit and scope of the claims will be apparent to those of skill in the art upon reviewing the description and illustrations. The scope of the subject matter described and/or illustrated herein should therefore be determined with reference to the appended claims, along with the full scope of equivalents to which such claims are entitled. Further, the limitations of the following claims are not written in means-plus-function format and are not intended to be interpreted based on 35 U.S.C. § 112(f), unless and until such claim limitations expressly use the phrase "means for" followed by a statement of function void of further structure.

While the subject matter described and/or illustrated herein has been described in terms of various specific embodiments, those skilled in the art will recognize that the subject matter described and/or illustrated herein can be practiced with modification within the spirit and scope of the claims.

What is claimed is:

1. A connector assembly comprising, a conductive shell extending between a mating end configured for mating with a mating connector and a back end opposite the mating end, the conductive shell being generally cylindrical and extending along a longitudinal axis, the conductive shell having a base that extends between a front end of the base and the back end of the conductive shell, the conductive shell having a chamber forward of the base and being open at the mating end for receiving the mating connector, the base having an insulator pocket aligned with the longitudinal axis and extending between the chamber and the back end of the conductive shell;

a center pin received in the insulator pocket and extending through the base along the longitudinal axis into the chamber for mating with the mating connector, the center pin having a terminating end extending from the back end for termination to an electrical component, the center pin having a flange extending circumferentially around the center pin, wherein the flange has an outer diameter that is larger than an outer diameter of the center pin; and an insulator formed in place in the insulator pocket of the conductive shell around the center pin, the insulator comprising a rear end and a front end, wherein the rear end of the insulator and the back end of the conductive shell are coplanar and wherein the front end of the insulator and the front end of the base are coplanar, the insulator being of an insulating material to electrically isolate the center pin from the conductive shell, the insulator maintaining a position of the center pin along the longitudinal axis.

2. The connector assembly of claim 1, wherein the conductive shell, the insulator, and the center pin are concentric about the longitudinal axis.

3. The connector assembly of claim 1, the insulator pocket further comprising a locking groove and the insulator further comprising a locking rib, wherein the locking groove receives the locking rib to hold an axial position of the insulator relative to the base.

4. The connector assembly of claim 3, wherein the locking groove extends entirely circumferentially around the insulator pocket.

5. The connector assembly of claim 1, wherein the the insulator is configured to be formed around the flange to hold an axial position of the center pin relative to the insulator.

6. The connector assembly of claim 1, wherein the insulator includes a molded body positioned in the insulator pocket around the center pin and embedded into the conductive shell.

7. The connector assembly of claim 1, the conductive shell further comprising one or more pin pockets in the base, wherein one or more connector pins are received in corresponding pin pockets for mechanical and electrical connection of the conductive shell to the electrical component.

8. The connector assembly of claim 1, further comprising one or more connector pins, wherein the connector pins extend rearward from the back end of the conductive shell for mechanical and electrical connection of the conductive shell to the electrical component.

9. The connector assembly of claim 1, the conductive shell further comprising a standoff at the back end configured to be soldered to the electrical component.

10. The connector assembly of claim 1, wherein the insulator has an insulator outer diameter, the insulator pocket having a front diameter at a front of the base and a rear diameter at a rear of the base, the insulator outer diameter of the insulator being greater than the front diameter of the insulator pocket and the insulator outer diameter of the insulator being greater than the rear diameter of the insulator pocket.

11. The connector assembly of claim 1, wherein the insulator has a central bore having a front bore diameter and a rear bore diameter at a front end and the rear end of the insulator respectively, the center pin extending through the central bore, the center pin having a pin outer diameter being greater than the front bore diameter and the rear bore diameter.

12. The connector assembly of claim 1, wherein the insulator includes a front shoulder and a rear shoulder oriented perpendicular to the longitudinal axis, the front shoulder and the rear shoulder engaging the base to hold an axial position of the insulator relative to the base.

13. The connector assembly of claim 1, wherein the insulator is injection molded into the insulator pocket in situ.

14. The connector assembly of claim 1, wherein a concentric space is defined around the center pin between the center pin and the base, the insulator being formed in place in the concentric space around the center pin.

15. A method of assembling a connector assembly, comprising:

providing a generally cylindrical, conductive shell with an insulator pocket formed through a base of the conductive shell between a back end of the conductive shell and a chamber at a mating end of the conductive shell;

positioning a center pin along a longitudinal axis of the conductive shell such that the center pin extends from the insulator pocket rearward of the back end of the conductive shell and such that the center pin extends forward of the insulator pocket into the chamber for mating with a mating connector, wherein the center pin includes a flange extending circumferentially around the center pin, wherein the flange has an outer diameter that is larger than an outer diameter of the center pin; and injection molding an insulator in the insulator pocket around the center pin, the insulator comprising a rear end that is observed at the back end of the conductive shell, wherein the rear end and the back end are coplanar, the insulator being locked into the base to maintain a position of the center pin relative to the conductive shell along the longitudinal axis.

16. The method of claim 15, further comprising joining one or more connector pins to the conductive shell in corresponding pin pockets such that the connector pins extend rearward from the back end.

17. A connector assembly comprising, a conductive shell extending between a mating end configured for mating with a mating connector and a back end opposite the mating end, the conductive shell having a base at the back end, the base having an insulator pocket;

a center pin received in the insulator pocket and extending through the base for mating with the mating connector, the center pin having a terminating end extending from the back end for termination to an electrical component, the center pin having a flange extending circumferentially around the center pin, wherein the flange has an outer diameter that is larger than an outer diameter of the center pin; and an insulator formed into the insulator pocket of the conductive shell around the center pin to electrically isolate the center pin from the conductive shell, the insulator comprising a rear end that is observed at the back end of the conductive shell, wherein the rear end and the back end are coplanar, the insulator being of an insulating material, wherein the insulator is injection molded in situ into the insulator pocket, the insulator maintaining a position of the center pin relative to the base along a longitudinal axis.

18. The connector assembly of claim 17, wherein the conductive shell, the insulator, and the center pin are concentric about the longitudinal axis.

19. The connector assembly of claim 17, the insulator pocket further comprising a locking groove and the insulator further comprising a locking rib, wherein the locking groove receives the locking rib to hold an axial position of the insulator relative to the base.

20. The connector assembly of claim 17, further comprising one or more connector pins, wherein the connector pins extend rearward from the back end of the conductive shell for mechanical and electrical connection of the conductive shell to the electrical component.

* * * * *